US010152961B2

(12) United States Patent
Tsuchiya et al.

(10) Patent No.: US 10,152,961 B2
(45) Date of Patent: Dec. 11, 2018

(54) SIGNAL PROCESSING DEVICE AND SIGNAL PROCESSING METHOD

(71) Applicant: SONY CORPORATION, Tokyo (JP)

(72) Inventors: Shinpei Tsuchiya, Kanagawa (JP); Kazunobu Ookuri, Kanagawa (JP); Tetsunori Itabashi, Kanagawa (JP); Kohei Asada, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/512,737

(22) PCT Filed: Aug. 25, 2015

(86) PCT No.: PCT/JP2015/073820
§ 371 (c)(1),
(2) Date: Mar. 20, 2017

(87) PCT Pub. No.: WO2016/059878
PCT Pub. Date: Apr. 21, 2016

(65) Prior Publication Data

US 2017/0301335 A1 Oct. 19, 2017

(30) Foreign Application Priority Data

Oct. 16, 2014 (JP) ..... 2014-211762

(51) Int. Cl.
*G10K 11/178* (2006.01)

(52) U.S. Cl.
CPC ..... *G10K 11/178* (2013.01); *G10K 11/17823* (2018.01); *G10K 11/17827* (2018.01);
(Continued)

(58) Field of Classification Search
CPC ..... G10K 11/178; G10K 2210/1053; G10K 2210/3016; G10K 2210/3028;
(Continued)

(56) References Cited

U.S. PATENT DOCUMENTS

2008/0159555 A1* 7/2008 Asada ..... G10K 11/178 381/71.11
2009/0034748 A1 2/2009 Sibbald
(Continued)

FOREIGN PATENT DOCUMENTS

AT 550754 T 4/2012
CN 101222787 A 7/2008
(Continued)

OTHER PUBLICATIONS

Extended European Search Report of EP Patent Application No. 15851236.8, dated May 4, 2018, 9 pages of EESR.

*Primary Examiner* — Jason R Kurr
(74) *Attorney, Agent, or Firm* — Chip Law Group

(57) ABSTRACT

Provided is a signal processing device including a signal analyzing unit configured to analyze a second audio signal based on a first audio signal which is input and a sound collected through a microphone, a cancellation processing unit configured to generate a cancellation signal for canceling the second audio signal, and a parameter generating unit configured to generate a control parameter used in the cancellation processing unit based on a result of analysis performed by the signal analyzing unit.

11 Claims, 15 Drawing Sheets

(52) U.S. Cl.
CPC .. *G10K 11/17873* (2018.01); *G10K 11/17885* (2018.01); *G10K 2210/1053* (2013.01); *G10K 2210/3016* (2013.01); *G10K 2210/3028* (2013.01)

(58) Field of Classification Search
CPC ..... G10K 11/17823; G10K 11/17873; G10K 11/17885; G10K 11/17827
USPC ..... 381/73.1, 71.1, 71.8, 71.14
See application file for complete search history.

(56) References Cited

U.S. PATENT DOCUMENTS

| | | | | |
|---|---|---|---|---|
| 2009/0190772 | A1* | 7/2009 | Osada | H04R 3/04 381/73.1 |
| 2009/0214050 | A1* | 8/2009 | Sawashi | H04R 3/04 381/73.1 |
| 2010/0260345 | A1* | 10/2010 | Shridhar | G10K 11/178 381/71.1 |
| 2010/0310086 | A1 | 12/2010 | Magrath et al. | |
| 2011/0026724 | A1 | 2/2011 | Doclo | |
| 2012/0259626 | A1 | 10/2012 | Li et al. | |
| 2015/0078569 | A1 | 3/2015 | Magrath et al. | |
| 2017/0213537 | A1 | 7/2017 | Magrath et al. | |
| 2017/0213538 | A1 | 7/2017 | Magrath et al. | |
| 2017/0213539 | A1 | 7/2017 | Magrath et al. | |

FOREIGN PATENT DOCUMENTS

| | | | |
|---|---|---|---|
| CN | 101385385 | A | 3/2009 |
| CN | 101859563 | A | 10/2010 |
| CN | 101903941 | A | 12/2010 |
| CN | 101989423 | A | 3/2011 |
| CN | 102881281 | A | 1/2013 |
| CN | 104751839 | A | 7/2015 |
| EP | 1940197 | A1 | 7/2008 |
| EP | 2002687 | A1 | 12/2008 |
| EP | 2239728 | A2 | 10/2010 |
| EP | 2284831 | A1 | 2/2011 |
| GB | 2436657 | A | 10/2007 |
| GB | 2455822 | A | 6/2009 |
| GB | 2479672 | A | 10/2011 |
| GB | 2479673 | A | 10/2011 |
| GB | 2479674 | A | 10/2011 |
| GB | 2479675 | A | 10/2011 |
| JP | 2008-164670 | A | 7/2008 |
| JP | 2008-193421 | A | 8/2008 |
| JP | 2009-532926 | A | 9/2009 |
| JP | 2010-244045 | A | 10/2010 |
| JP | 5007561 | B2 | 8/2012 |
| JP | 2012-181541 | A | 9/2012 |
| JP | 5254204 | B2 | 8/2013 |
| JP | 5705780 | B2 | 4/2015 |
| WO | 2007/113487 | A1 | 10/2007 |
| WO | 2009/081187 | A1 | 7/2009 |

* cited by examiner

SIGNAL PROCESSING DEVICE AND SIGNAL PROCESSING METHOD

CROSS REFERENCE TO RELATED APPLICATIONS

This application is a U.S. National Phase of International Patent Application No. PCT/JP2015/073820 filed on Aug. 25, 2015, which claims priority benefit of Japanese Patent Application No. JP 2014-211762 filed in the Japan Patent Office on Oct. 16, 2014. Each of the above-referenced applications is hereby incorporated herein by reference in its entirety.

TECHNICAL FIELD

The present disclosure relates to a signal processing device, a signal processing method, and a computer program.

BACKGROUND ART

With the popularization of portable audio players, noise reduction systems that provide a satisfactory reproduced sound field space by reducing noise of an external environment for headphones or earphones for portable audio players or reducing external noise for listeners have begun to spread.

For example, Patent Literature 1 discloses a technique of a noise reduction system capable of generating a noise cancellation signal of an opposite phase in which a sound pressure of noise becomes minimum at ears of a listener using a noise signal collected through a microphone that collects ambient noise and cancelling noise.

CITATION LIST

Patent Literature

Patent Literature 1: JP 2008-193421A

DISCLOSURE OF INVENTION

Technical Problem

The noise cancellation signal is generated based on noise around the listener without depending on an audio signal supplied to headphones or earphones. If the noise cancellation signal can be effectively generated based on the audio signal, it is possible to effectively use resources for processing.

In this regard, the present disclosure proposes a signal processing device, a signal processing method, and a computer program, which are novel and improved and capable of effectively using resources for generating the noise cancellation signal.

Solution to Problem

According to the present disclosure, there is provided a signal processing device including: a signal analyzing unit configured to analyze a second audio signal based on a first audio signal which is input and a sound collected through a microphone; a cancellation processing unit configured to generate a cancellation signal for canceling the second audio signal; and a parameter generating unit configured to generate a control parameter used in the cancellation processing unit based on a result of analysis performed by the signal analyzing unit.

In addition, according to the present disclosure, there is provided a signal processing method including: analyzing a second audio signal based on a first audio signal which is input and a sound collected through a microphone; generating a cancellation signal for canceling the second audio signal; and generating a control parameter used in the generation of the cancellation signal based on a result of the analysis.

In addition, according to the present disclosure, there is provided a computer program causing a computer to execute: analyzing a second audio signal based on a first audio signal which is input and a sound collected through a microphone; generating a cancellation signal for canceling the second audio signal; and generating a control parameter used in the generation of the cancellation signal based on a result of the analysis.

Advantageous Effects of Invention

As described above, according to the present disclosure, it is possible to provide a signal processing device, a signal processing method, and a computer program which are novel and improved and capable of effectively using resources for generating the noise cancellation signal.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
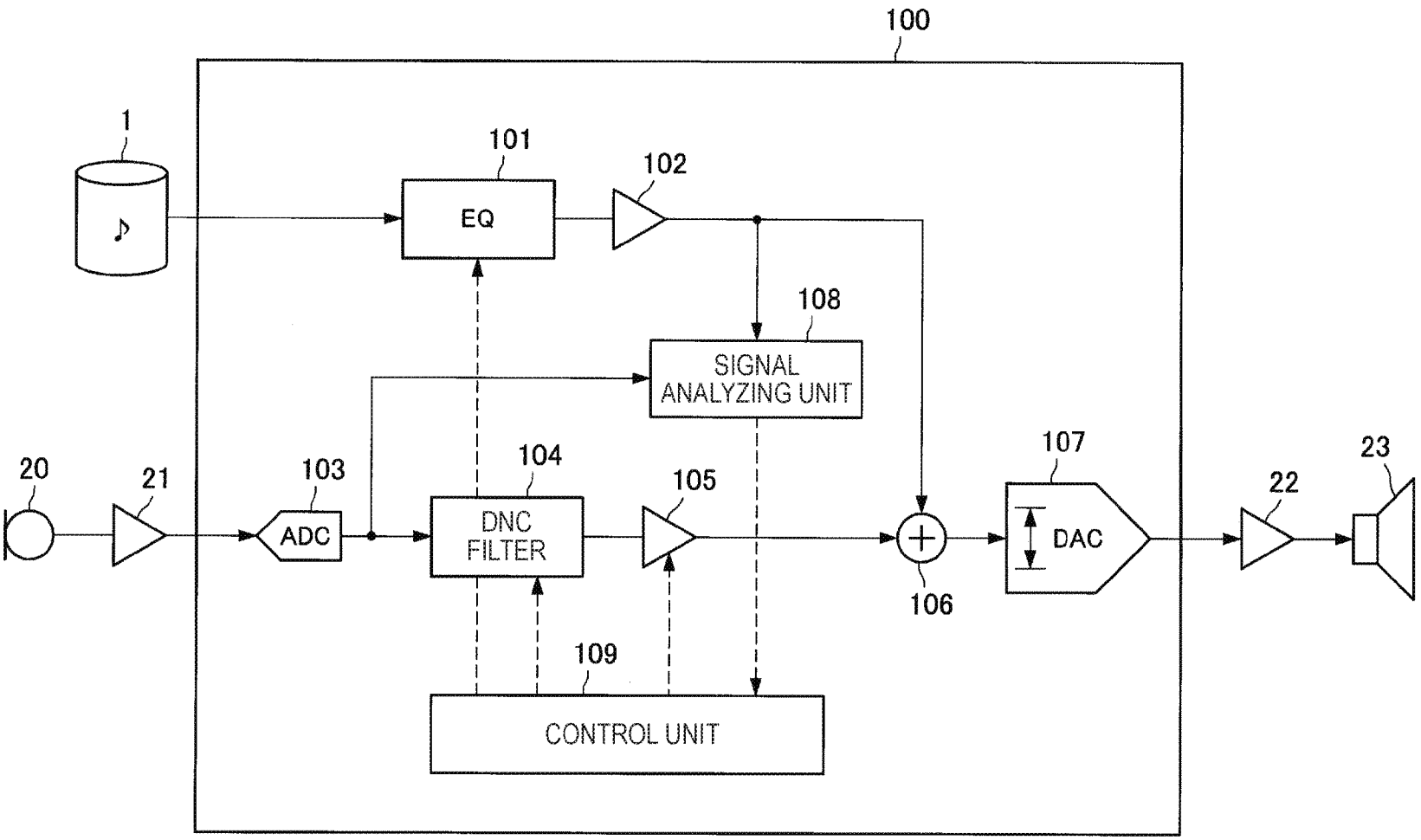
FIG. 1 is an explanatory diagram illustrating an exemplary functional configuration of a signal processing device 100 according to an embodiment of the present disclosure.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

Description will proceed in the following order.

1. Embodiment of present disclosure
1.1. Overview
1.2. Exemplary functional configuration
1.3. Exemplary operation
1.4. Application examples
2. Conclusion

1. Embodiment of Present Disclosure

1.1. Overview

An overview of an embodiment of the present disclosure will be described first before an embodiment of the present disclosure is described.

Figure 14:
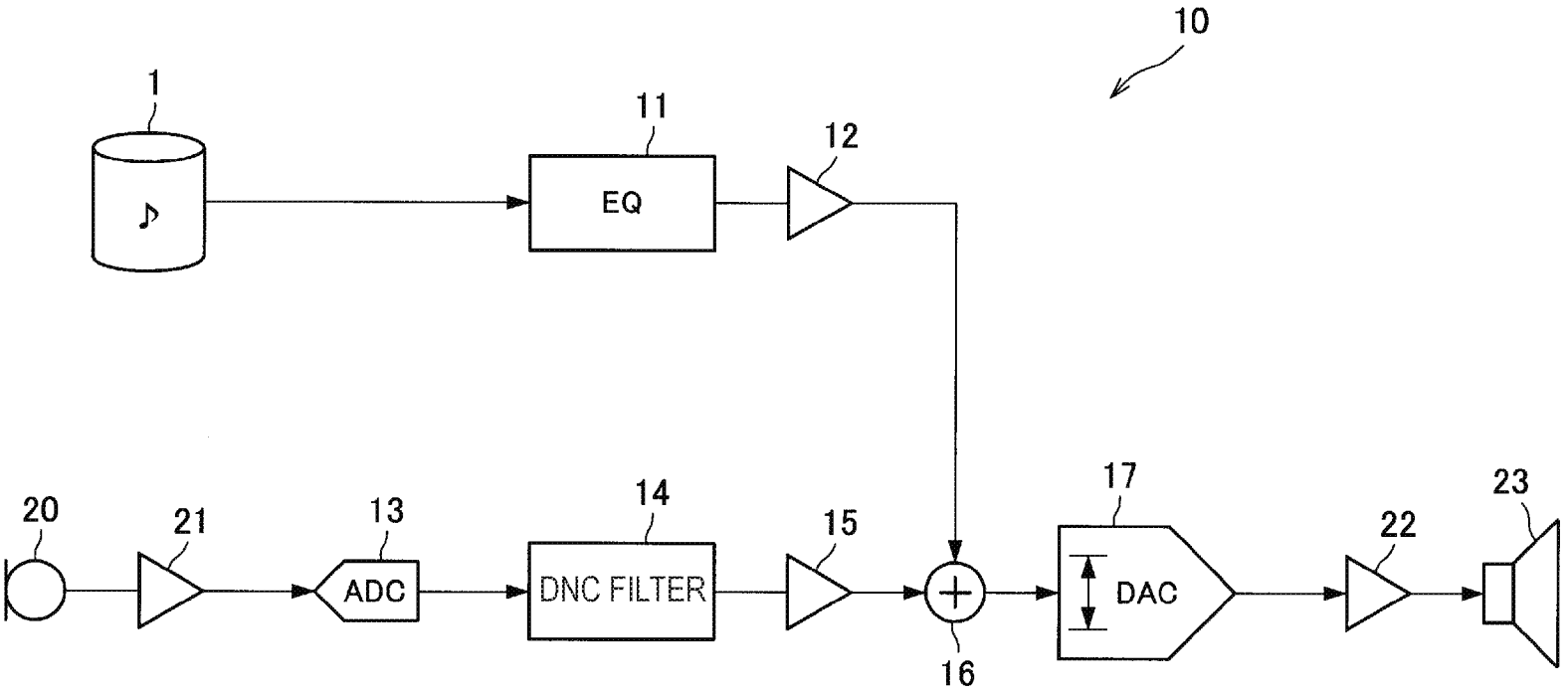
FIG. 14 is an explanatory diagram illustrating an exemplary configuration of a signal processing device 10 that performs a noise cancellation function according to a related art.

FIG. 14 is an explanatory diagram illustrating an exemplary configuration of a signal processing device 10 that performs a noise cancellation function according to a related art. The signal processing device 10 that performs a noise cancellation function according to a related art includes, for example, an equalizer 11 that adjusts a frequency characteristic for an audio signal 1, a volume adjustment unit 12 that adjusts a gain of the audio signal output from the equalizer 11, an AD converter (ADC) 13 that converts a noise signal which is collected through the microphone 20 and amplified by a microphone amplifier 21 into a digital signal, a digital noise canceling (DNC) filter 14 that generates a noise cancellation signal, a cancellation amount adjusting unit 15 that adjusts a noise cancellation amount, an adding unit 16 that causes the noise cancellation signal to be superimposed on the audio signal, and a DA converter (DAC) 17 that converts an output of the adding unit 16 into an analog signal. An output signal of the DA converter 17 is amplified by an amplifier 22 of headphones and then output from a driver 23, so that a sound is transmitted to a listener.

As described above, the noise cancellation signal is generated based on the noise around the listener without depending on the audio signal supplied to the headphones or the earphones. In other words, the signal processing device 10 illustrated in FIG. 14 generates the noise cancellation signal through the DNC filter 14 regardless of the audio signal. That is, it is difficult to say that the signal processing device 10 that performs the noise cancellation function according to the related art generates the noise cancellation signal in all frequency bands and effectively uses resources for processing.

In this regard, the authors of the present disclosure carried out intensive studies on a technology capable of performing a more efficient noise cancellation process using characteristics of human hearing.

For example, when a listener uses the noise cancellation function while listening to a sound output based on the audio signal, noise is masked by the sound based on the audio signal due to the characteristics of human hearing, and the noise cancellation signal is generated even in the frequency band in which no noise was originally perceived by the listener.

This is a phenomenon included in characteristics of human hearing called a masking effect. In other words, the masking effect is a phenomenon in which, when another sound is output while a certain sound is being heard, the second sound is masked by the first sound and not heard. When a listener listens to a sound output from headphones or earphones, the listener uses the noise cancellation function since it is difficult to hear the sound due to ambient noise, but depending on levels or frequency characteristics of the audio signal and the ambient noise, there are cases in which the sound based on the audio signal works as a masker affecting the masking effect and masks noise.

Figure 15:
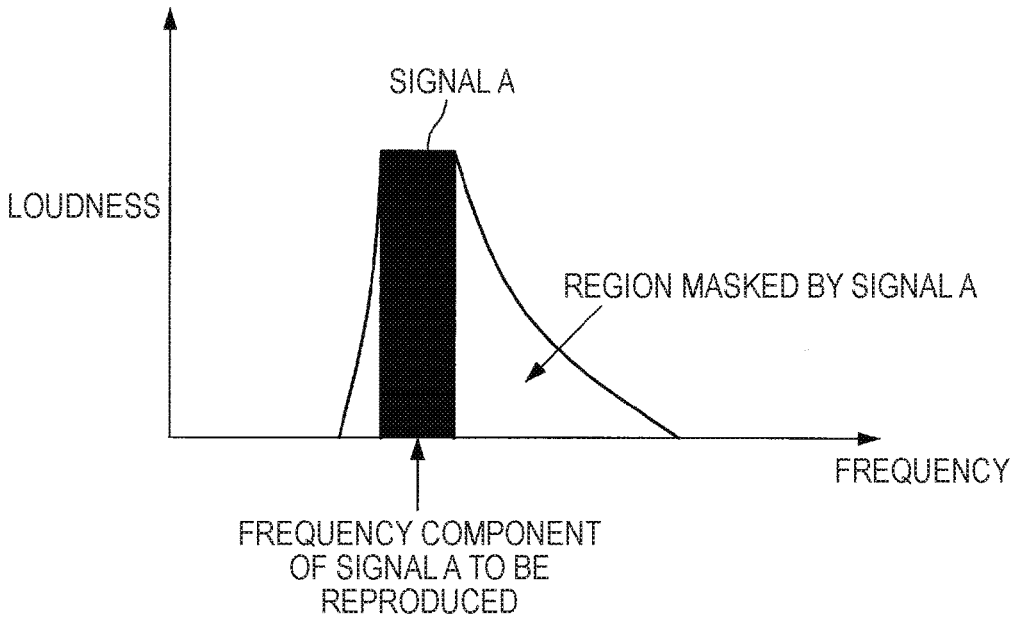
FIG. 15 is an explanatory diagram illustrating a masking effect.

FIG. 15 is an explanatory diagram for describing the masking effect. For example, when there is a signal A that is reproduced at a certain frequency band, a region masked by a sound based on the signal A occurs depending on loudness of the signal A (the magnitude of the sound). Generally, as illustrated in FIG. 15, a sound of a higher frequency band than a certain signal is masked by a sound output based on a certain signal. The range to be masked depends on a frequency or a size of the sound.

Therefore, in the band in which noise is masked by the audio signal due to the masking effect, the presence of noise is ignored by the sound based on the audio signal even though the noise cancellation process is not actively performed. A loudness chart which simulates frequency masking is specified in ISO 532 B, and it is possible to calculate a frequency band to be masked using the loudness chart.

In this regard, as will be described below, the authors of the present disclosure have come up with a technology capable of performing a more efficient noise cancellation process using characteristics of human hearing.

The overview of an embodiment of the present disclosure has been described above. Next, an embodiment of the present disclosure will be described in detail. First, an exemplary functional configuration of a signal processing device according to an embodiment of the present disclosure will be described.

1.2. Exemplary Functional Configuration

FIG. 1 is an explanatory diagram illustrating an exemplary functional configuration of a signal processing device 100 according to an embodiment of the present disclosure. The signal processing device 100 illustrated in FIG. 1 is a device that performs a noise cancellation process of collecting noise around a listener, canceling the collected noise, and enabling the listener wearing headphones to listen to a sound based on an audio signal satisfactorily. An exemplary functional configuration of the signal processing device 100 according to an embodiment of the present disclosure will be described below with reference to FIG. 1.

As illustrated in FIG. 1, the signal processing device 100 according to an embodiment of the present disclosure includes an equalizer 101, a volume adjusting unit 102, an AD converter (ADC) 103, a DNC filter 104, a cancellation amount adjusting unit 105, an adding unit 106, a DA converter (DAC) 107, a signal analyzing unit 108, and a control unit 109.

The equalizer 101 changes a frequency characteristic for an audio signal 1 to be supplied to the signal processing device 100. The equalizer 101 changes the frequency characteristic, for example, increases or decreases a low tone range or increases or decreases a high tone range. For example, a setting of the change in the frequency characteristic by the equalizer 101 can be performed by the listener. An audio signal whose frequency characteristic has been changed by the equalizer 101 is transferred to the volume adjusting unit 102.

The volume adjusting unit 102 adjusts a volume of the sound output from the driver 23 by adjusting a gain of the audio signal whose frequency characteristic has been changed by the equalizer 101. For example, a setting of a volume adjustment amount by the volume adjusting unit 102 can be performed by the listener. The volume adjusting unit 102 transfers the audio signal having the adjusted gain to the adding unit 106. The audio signal whose gain has been adjusted by the volume adjusting unit 102 is transferred to the adding unit 106 and added to the noise cancellation signal. The volume adjusting unit 102 also transfers the audio signal having the adjusted gain to the signal analyzing unit 108.

The AD converter 103 converts an analog noise signal which is obtained by collecting external noise through a microphone 20 and then amplified by the microphone amplifier 21 into a digital noise signal. A configuration of the AD converter 103 is not limited to a specific configuration. For example, the AD converter 103 may include a delta sigma modulator or a decimation filter in order to perform conversion into a digital signal having the same sampling frequency or the same number of quantization bits as the audio signal 1 as disclosed in JP 2008-193421A. The AD converter 103 outputs the digital noise signal to the DNC filter 104. Further, the AD converter 103 transfers the digital noise signal to the signal analyzing unit 108.

The DNC filter 104 generates a noise cancellation signal for canceling the external noise using the digital noise signal output from the AD converter 103. In other words, when the sound output from the driver 23 reaches the ears of the listener, the DNC filter 104 generates a noise cancellation signal having an effect in which the external noise is canceled, and only the sound based on the audio signal is heard by the listener. In other words, the DNC filter 104 generates a noise cancellation signal having a characteristic of an opposite phase to the external noise reaching the ears of the user. The DNC filter 104 outputs the generated noise cancellation signal to the cancellation amount adjusting unit 105.

The DNC filter 104 is configured as, for example, an FIR filter or an IIR filter. Further, in the present embodiment, the DNC filter 104 can change a filter to be used or a filter coefficient according to a control parameter generated by the control unit 109 which will be described later. When the filter to be used in the DNC filter 104 and the filter coefficient are changed according to the control parameter generated by the control unit 109, the signal processing device 100 according to the present embodiment can effectively use resources for generating the noise cancellation signal.

The cancellation amount adjusting unit 105 adjusts a gain of the noise cancellation signal generated by the DNC filter 104. The cancellation amount adjusting unit 105 adjusts the cancellation amount of the external noise collected through the microphone 20 by adjusting the gain of the noise cancellation signal. The cancellation amount adjusting unit 105 outputs the noise cancellation signal having the adjusted gain to the adding unit 106.

The adding unit 106 combines (adds) the audio signal whose gain has been adjusted by the volume adjusting unit 102 and the noise cancellation signal whose gain has been adjusted by the cancellation amount adjusting unit 105. Since the audio signal and the noise cancellation signal are combined by the adding unit 106, it is possible to cancel the external noise and enable the listener to hear only the sound based on the audio signal when the sound output from the driver 23 reaches the ears of the listener. When the audio signal is combined with the noise cancellation signal, the adding unit 106 outputs the combined digital signal to the DA converter 107.

The DA converter 107 converts the digital signal output from the adding unit 106 into an analog signal. A configuration of the DA converter 107 is not limited to a specific configuration, but for example, the DA converter 107 is configured to include an oversampling filter, a delta sigma modulator, and an analog low pass filter (LPF) as disclosed in JP 2008-193421A. When the digital signal output from the adding unit 106 is converted into the analog signal, the DA converter 107 outputs the converted analog signal to the headphone amplifier 22.

The headphone amplifier 22 that has received the analog signal generated by the DA converter 107 amplifies the signal by a predetermined amount and outputs the amplified signal to the driver 23. The driver 23 outputs a sound based on the analog signal transferred from the headphone amplifier 22.

The signal analyzing unit 108 performs an analysis process on the audio signal having the adjusted gain output from the volume adjusting unit 102 and the digital noise signal output from the AD converter 103. In the present embodiment, the signal analyzing unit 108 calculates masking effects of the ambient noise and the audio signal based on the ambient noise and the audio signal.

Specifically, the signal analyzing unit 108 performs an analysis process for determining a frequency in which a sound is included and an amount of the sound in real time by performing frequency analysis on the audio signal and the noise signal in real time. Then, the signal analyzing unit 108 analyzes a frequency band and an amount in which the masking effect is shown when the audio signal works as a masker and a frequency band and an amount in which the masking effect is shown when the noise signal works as a masker using the frequency analysis results for the audio signal and the noise signal.

The signal analyzing unit 108 analyzes a frequency and a level of each of the audio signal and the noise signal, and calculates the masking effect using analysis results of the frequency and the level of each of the audio signal and the noise signal and the loudness chart.

The signal analyzing unit 108 outputs the result of the analysis process to the control unit 109. The signal analyzing unit 108 transfers a parameter indicating a frequency band in which a noise cancellation effect is determined to be high or low as the result of the analysis process.

The control unit 109 generates a control parameter which is used by the DNC filter 104 using the result of the analysis process performed by the signal analyzing unit 108. Accordingly, the control unit 109 can function as an example of the parameter generating unit of the present disclosure. For example, the control unit 109 may be configured with a microcomputer. The control unit 109 controls the generation of the noise cancellation signal performed by the DNC filter 104 using the parameter indicating the frequency band in which the noise cancellation effect is high or low, which is transmitted from the signal analyzing unit 108. Further, the control unit 109 may perform control such that the cancellation amount is adjusted by the cancellation amount adjusting unit 105 using the result of the analysis process performed by the signal analyzing unit 108.

For example, when the parameter transferred from the signal analyzing unit 108 is a parameter indicating that the noise cancellation effect is high at the low frequency, and the noise cancellation effect is low at the intermediate frequency, the control unit 109 controls the generation of the noise cancellation signal performed by the DNC filter 104 such that noise at the low frequency can be further canceled, and noise at the intermediate frequency is not canceled. By performing such control, the signal processing device 100 according to the embodiment of the present disclosure can allocate resources through a process of canceling the low frequency noise.

Further, when the parameter transferred from the signal analyzing unit 108 is a parameter indicating that the noise cancellation effect is high in all frequency bands, the control unit 109 controls the generation of the noise cancellation signal performed by the DNC filter 104 such that noise is canceled within a range of resources in all frequency bands.

Further, the control unit 109 may generate a control parameter for controlling the equalizer 101 using the result of the analysis process performed by the signal analyzing unit 108. For example, when the result of the analysis process performed by the signal analyzing unit 108 indicates that the low frequency portion of the audio signal 1 is masked by the ambient noise, the control unit 109 outputs a parameter for emphasizing the low frequency portion of the audio signal 1 to the equalizer 101.

When the parameter for emphasizing the low frequency portion of the audio signal 1 to the equalizer 101 and the low frequency portion of the audio signal 1 is emphasized by the equalizer 101, the signal processing device 100 can enable the listener to hear even the low frequency of the audio signal 1 satisfactorily.

It is an extreme example, but for example, in the case of an environment in which there is no noise at all or when noise signals of all bands are masked by the audio signal 1, it is unnecessary to reproduce the noise cancellation signal for the noise cancellation process.

Therefore, when it is unnecessary to reproduce the noise cancellation signal for the noise cancellation process, only the audio signal 1 is transferred to the DA converter 107, that is, a reproduction state similar to a state in which no noise cancellation function is used is formed.

The signal processing device 100 according to the embodiment of the present disclosure has the configuration illustrated in FIG. 1 and thus can perform the more efficient noise cancellation process within the range of resources using the masking effect characteristic of human hearing.

In FIG. 1, the audio signal 1 is illustrated as being supplied from the outside of the signal processing device 100 to the signal processing device 100, but the present disclosure is not limited to this example, and for example, the audio signal 1 may be based on audio data recorded in the signal processing device 100.

The exemplary functional configuration of the signal processing device 100 according to the embodiment of the present disclosure has been described above. Next, an exemplary operation of the signal processing device 100 according to the embodiment of the present disclosure will be described.

1.3. Exemplary Operation

Figure 2:
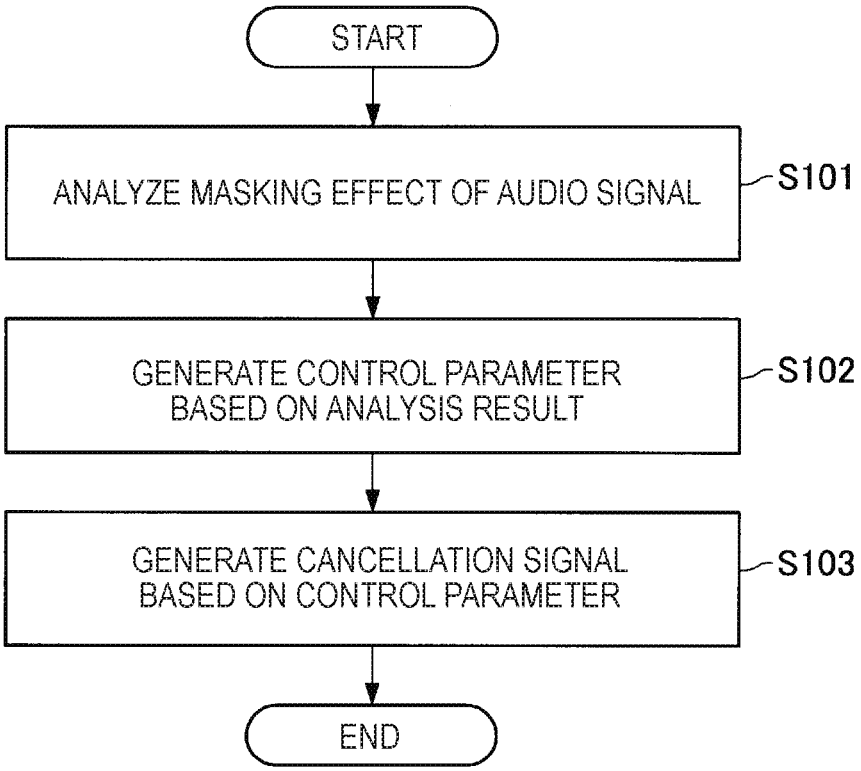
FIG. 2 is a flow diagram illustrating an exemplary operation of the signal processing device 100 according to an embodiment of the present disclosure.

FIG. 2 is a flow diagram illustrating an exemplary operation of the signal processing device 100 according to the embodiment of the present disclosure. FIG. 2 illustrates an exemplary operation of the signal processing device 100 according to the embodiment of the present disclosure when the noise cancellation process is performed. The exemplary operation of the signal processing device 100 according to the embodiment of the present disclosure will be described below with reference to FIG. 2.

The signal processing device 100 first analyzes the masking effect of the audio signal 1 for the ambient noise (step S101). The analysis process of the masking effect in step S101 may be executed by the signal analyzing unit 108. Further, the audio signal 1 that has passed through the equalizer 101 and the volume adjusting unit 102 and the digital noise signal that has passed through the microphone 20, the microphone amplifier 21, and the AD converter 103 are used in the analysis process of the masking effect in step S101.

In step S101, the frequency analysis is performed on the audio signal and the noise signal, and the analysis process for determining a frequency in which a sound is included and an amount of the sound is performed. Then, in step S101, a frequency band and an amount in which the masking effect is shown when the audio signal works as a masker and a frequency band and an amount in which the masking effect is shown when the noise signal works as a masker are analyzed using the frequency analysis results for the audio signal and the noise signal.

In step S101, a frequency and a level of each of the audio signal and the noise signal are analyzed, and the masking effect is calculated using analysis results of the frequency and the level of each of the audio signal and the noise signal and the loudness chart. Then, in step S101, the parameter indicating a frequency band in which a noise cancellation effect is high or low is generated.

When the masking effect of the audio signal 1 for the ambient noise is analyzed in step S101, the signal processing device 100 generates the control parameter based on the analysis result of step S101 (step S102). The process of generating the control parameter in step S102 may be executed by the control unit 109. The control parameter is a parameter for controlling the DNC filter 104 but may include a parameter for controlling the equalizer 101.

In step S102, the control parameter for controlling the DNC filter 104 is generated using the parameter indicating the frequency band in which the noise cancellation effect is high or low, which is generated as a result of the analysis process of step S101.

For example, when the parameter generated and transferred in step S101 is a parameter indicating that the noise cancellation effect is high at the low frequency, and the noise cancellation effect is low at the intermediate frequency, in step S102, the generation of the noise cancellation signal performed by the DNC filter 104 is controlled such that noise at the low frequency can be further canceled, and noise at the intermediate frequency is not canceled.

When the control parameter is generated in step S102, the signal processing device 100 generates the noise cancellation signal using the control parameter generated in step S102 (step S103). The process of generating the noise cancellation signal in step S103 may be executed by the DNC filter 104. When the process of generating the noise cancellation signal of step S103 is completed, the signal processing device 100 may return to step S101 and perform the analysis process again. Since the audio signal or the external noise can be changed sequentially, the signal processing device 100 may repeat the process of steps S101 to S103 while the noise cancellation process is being performed.

For example, when the control parameter that causes the noise at the low frequency to be further canceled and causes the noise at the intermediate frequency to not be canceled is generated in step S102, in step S103, the noise cancellation signal that further cancels the noise at the low frequency and does not cancel the noise at the intermediate frequency is generated.

Figure 3:
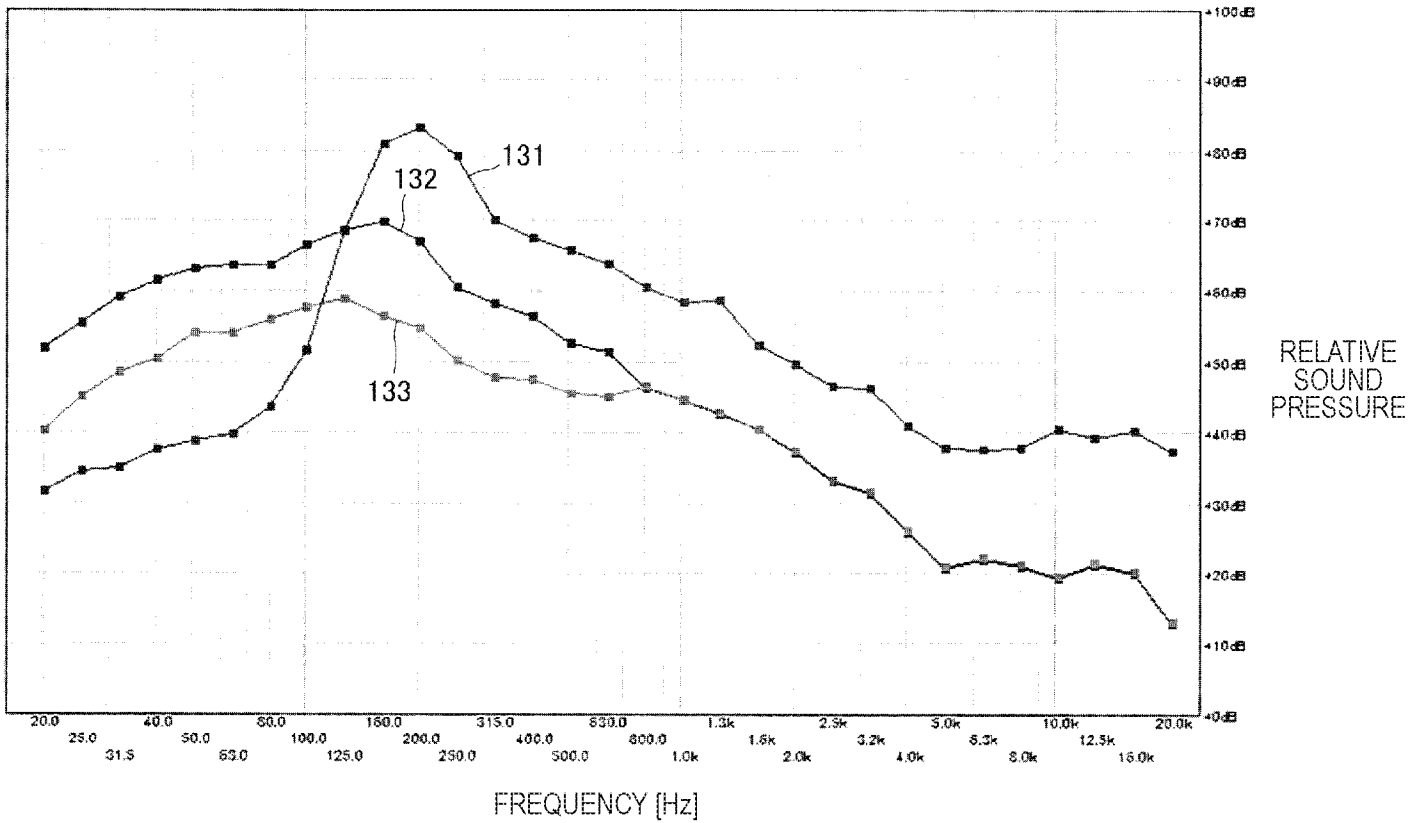
FIG. 3 is an explanatory diagram illustrating an example of frequency characteristics of an audio signal, a noise signal before noise cancellation, and a noise signal after noise cancellation.
Figure 4:
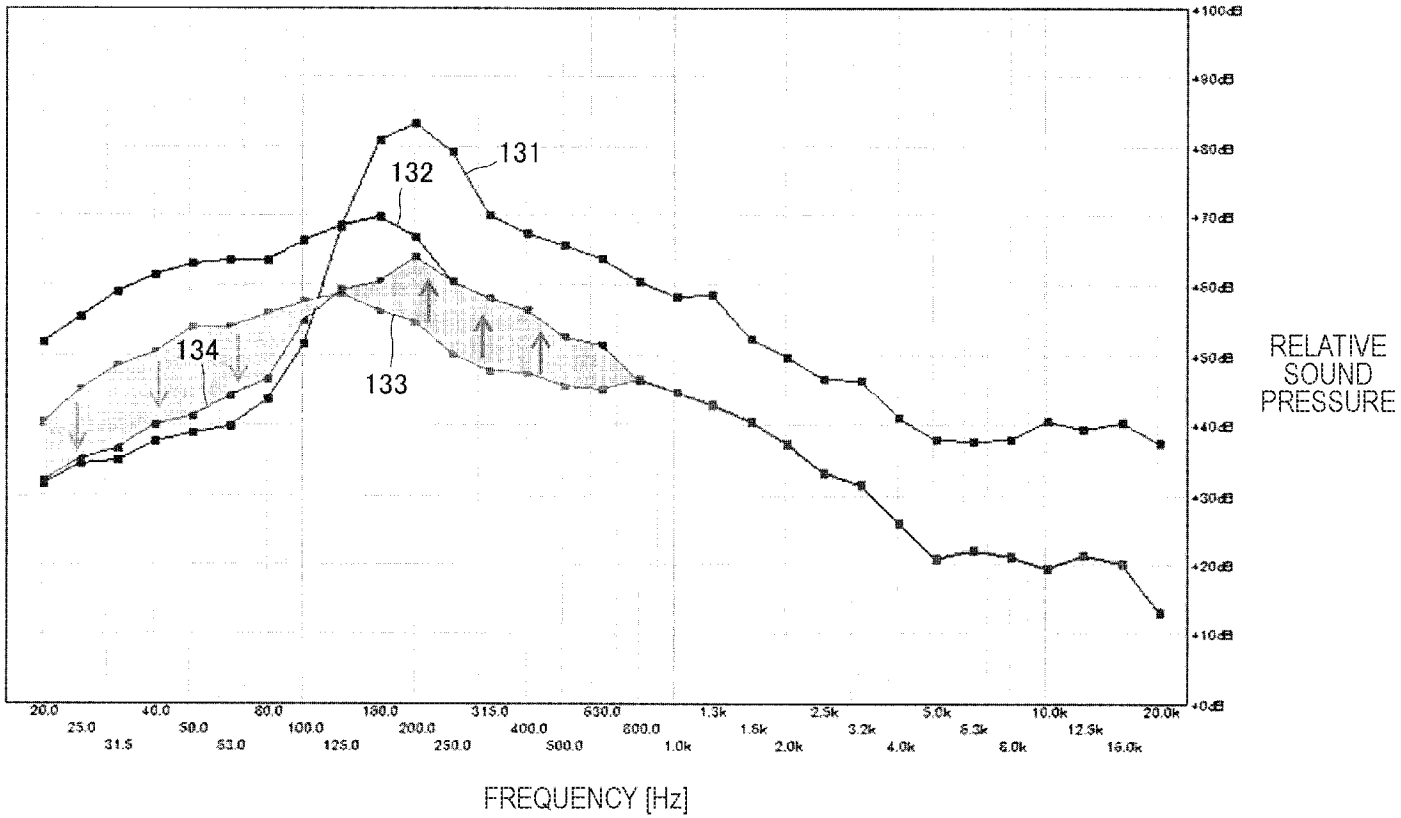
FIG. 4 is an explanatory diagram illustrating an example of frequency characteristics of an audio signal, a noise signal before noise cancellation, and a noise signal after noise cancellation.

Here, an example of the noise cancellation signal in which the masking effect is considered will be described. FIGS. 3 and 4 are explanatory diagrams illustrating examples of frequency characteristics of an audio signal, a noise signal before noise cancellation, and a noise characteristic after noise cancellation.

FIG. 3 is a graph of frequency characteristics of an audio signal, a noise signal before noise cancellation, and a noise signal from which noise has been canceled by the noise cancellation signal in which the masking effect is not considered.

FIG. 4 is a graph of frequency characteristics of an audio signal, a noise signal before noise cancellation, a noise signal from which noise has been canceled by the noise cancellation signal in which the masking effect is not considered, and a noise signal from which noise has been canceled by the noise cancellation signal in which the masking effect is considered.

In FIGS. 3 and 4, reference numeral 131 indicates a frequency characteristic of the audio signal, reference numeral 132 indicates a frequency characteristic of the noise signal in the ears of the user before noise cancellation, reference numeral 133 indicates a frequency characteristic of the noise signal in the ears of the user from which noise has been canceled by the noise cancellation signal in which the masking effect is not considered, and reference numeral 134 indicates a frequency characteristic of the noise signal in the ears of the user from which noise has been canceled by the noise cancellation signal in which the masking effect is considered. The frequency characteristics illustrated in FIGS. 3 and 4 are merely examples.

The signal analyzing unit 108 analyzes a characteristic of the audio signal and a characteristic of the noise signal, and for example, obtains the frequency characteristics indicated by reference numerals 131 and 132 and determines the masking effect of the noise signal based on the audio signal with reference to the loudness chart. Then, the signal analyzing unit 108 is assumed to determine that the noise cancellation effect is high at the low frequency, and the noise cancellation effect is low at the intermediate frequency.

As illustrated in FIG. 4, it is understood that, in the frequency characteristic 134 of the noise signal from which noise has been canceled by the noise cancellation signal in which the masking effect is considered, a relative sound pressure at the intermediate frequency is higher, but a relative sound pressure at the low frequency is lower than in the frequency characteristic 133 of the noise signal from which noise has been canceled by the noise cancellation signal in which the masking effect is not considered. In other words, processing resources of the DNC filter 104 are concentrated on the low frequency, and the cancellation effect is increased. At the intermediate frequency, the relative sound pressure of the noise signal is increasing, but since the noise at this frequency is masked by the masking effect of the audio signal, there is no change in an auditory sense of the listener.

The signal processing device 100 according to the embodiment of the present disclosure performs the operation illustrated in FIG. 2 and thus can perform the more efficient noise cancellation process within the range of resources using the masking effect characteristic of human hearing.

1.4. Modified Example

As described above, the signal processing device 100 according to the embodiment of the present disclosure analyzes the audio signal and the noise signal through the signal analyzing unit 108, analyzes the masking effect of the audio signal for the noise signal, and controls the generation of the noise cancellation signal performed by the DNC filter 104 through the control unit 109. The signal processing device 100 according to the embodiment of the present disclosure may prepare several patterns of the audio signal and the noise signals which are assumed in advance and switch the filter to be used in the DNC filter 104 using the analysis result of the signal analyzing unit 108.

Figure 5:
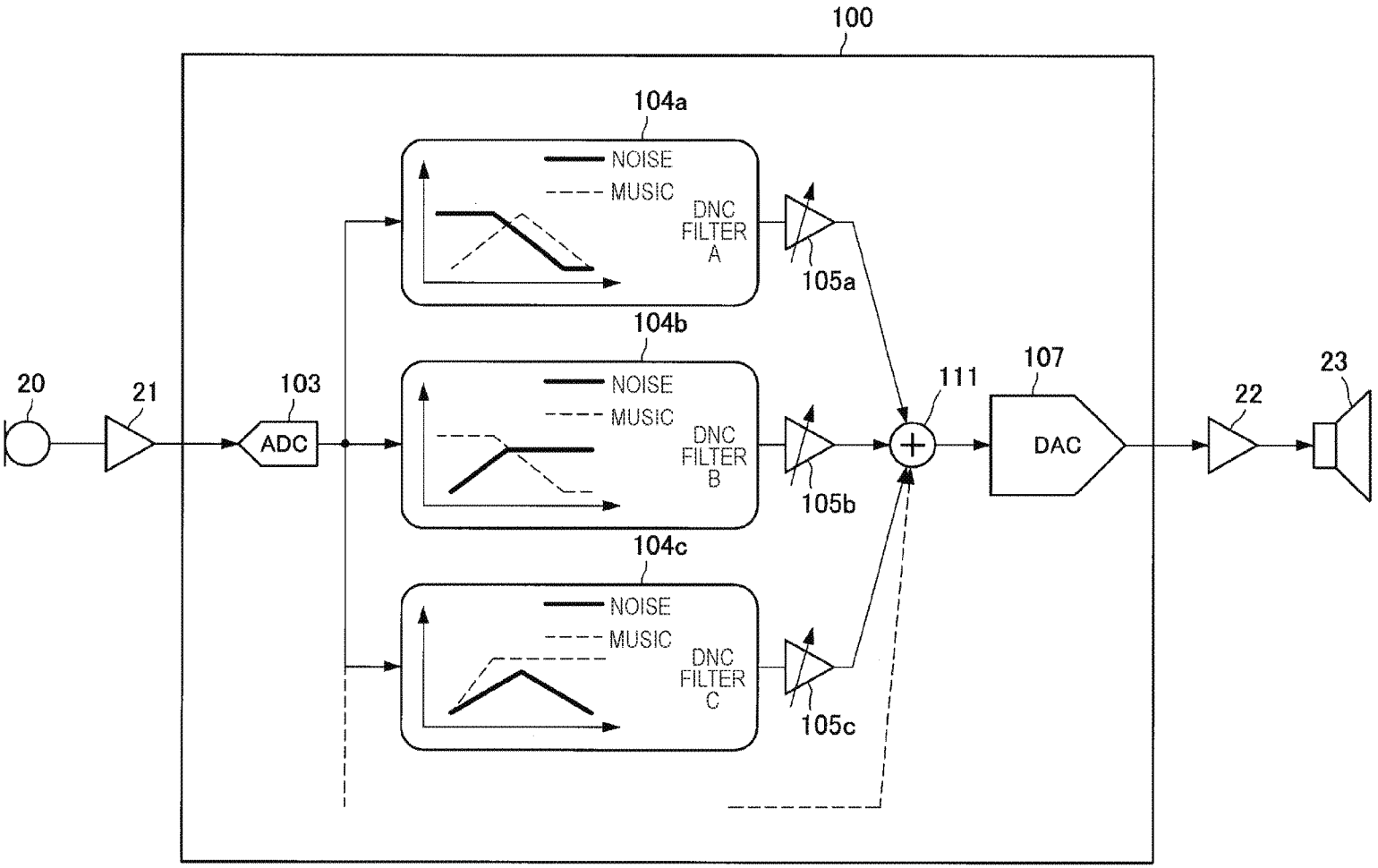
FIG. 5 is an explanatory diagram illustrating an exemplary configuration of the signal processing device 100 according to an embodiment of the present disclosure.

FIG. 5 is an explanatory diagram illustrating an exemplary configuration of a signal processing device 100 according to an embodiment of the present disclosure. FIG. 5 illustrates a configuration in which the DNC filter 104 and the cancellation amount adjusting unit 105 are modified in the configuration of the signal processing device 100 according to the embodiment of the present disclosure illustrated in FIG. 1. DNC filters 104*a*, 104*b*, 104*c*, and the like are filters whose parameters are set in advance according to the patterns of the audio signal and the noise signal which are assumed, and the control unit 109 selects one of the filters 104*a*, 104*b*, 104*c*, and the like based on the analysis results of the audio signal and the noise signal. Cancellation amount adjusting units 105*a*, 105*b*, 105*c*, and the like adjust gains of noise cancellation signals generated by the DNC filters 104*a*, 104*b*, 104*c*, and the like.

The signal processing device 100 according to the embodiment of the present disclosure which are equipped with a plurality of DNC filters 104*a*, 104*b*, 104*c*, and the like can perform the noise cancellation process while switching the filter according to characteristics of the audio signal and the noise signal.

The noise around the listener is attenuated by housings or earpieces of the headphones until it reaches the ears (eardrums) of the listener. In this regard, the signal processing device 100 according to the embodiment of the present disclosure may analyze the audio signal and the noise signal in view of the attenuation of the noise and analyze the masking effect of the audio signal for the noise signal.

Figure 6:
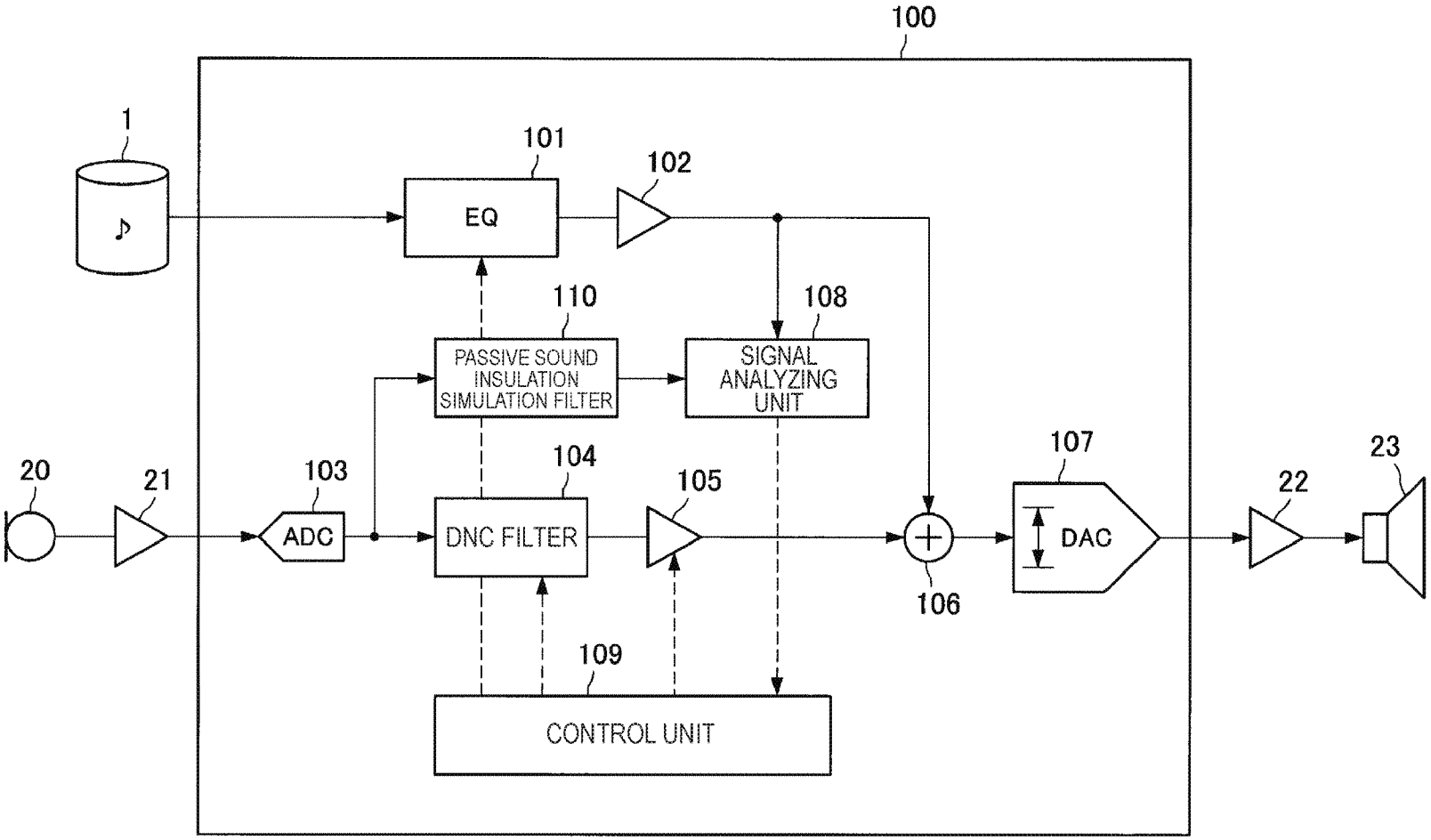
FIG. 6 is an explanatory diagram illustrating an exemplary functional configuration of the signal processing device 100 according to an embodiment of the present disclosure.

FIG. 6 is an explanatory diagram illustrating an exemplary functional configuration of a signal processing device 100 according to an embodiment of the present disclosure. FIG. 6 illustrates a configuration in which a passive sound insulation filter 110 is added to the exemplary functional configuration of the signal processing device 100 illustrated in FIG. 1. The passive sound insulation filter 110 is a filter in which a phenomenon in which the noise is attenuated before it reaches the ears (eardrums) of the listener is considered, that is, a filter that attenuates the digital noise signal output from the AD converter 103 by a predetermined amount. In other words, the passive sound insulation filter 110 is a filter that reproduces the effect in which the sound collected through the microphone 20 is attenuated, for example, by the housing of the headphone before it reaches the ears of the listener. The passive sound insulation filter 110 outputs the digital noise signal which has been attenuated by a predetermined amount to the signal analyzing unit 108.

Then, the signal analyzing unit 108 analyzes the audio signal 1 and the digital noise signal which has been attenuated by a predetermined amount through the passive sound insulation filter 110, and analyzes the masking effect of the audio signal for the digital noise signal which has been attenuated by a predetermined amount through the passive sound insulation filter 110.

The signal processing device 100 according to the embodiment of the present disclosure has the configuration illustrated in FIG. 6 and thus can analyze the masking effect for more realistic noise which the listener hear and perform the more efficient noise cancellation process within the range of resources.

As described above, the signal processing device 100 according to the embodiment of the present disclosure can analyze the audio signal and then perform the more efficient noise cancellation process, but by applying the analysis of the audio signal, it is possible to prevent the overflow of the audio signal after the noise cancellation in addition to an improvement in the noise cancellation effect.

Here, the overflow of the audio signal after the noise cancellation will be described. In the signal processing device 100 illustrated in FIG. 1, the noise cancellation signal output from the cancellation amount adjusting unit 105 and the audio signal output from the volume adjusting unit 102 are added by the adding unit 106. Then, a signal obtained by the addition performed by the adding unit 106 is converted into the analog signal through the DA converter 107, but when a signal before the conversion into the analog signal does not fall within a convertible range of the DA converter 107, the overflow occurs, and it is difficult to perform the digital-to-analog (DA) conversion properly.

For example, when the DA converter 107 is a 20-bit DA converter, a positive maximum value is 7FFFFh (=0.999 . . . ), and a negative maximum value is 80000h (=−1.0). Therefore, when the signal before the conversion into the analog signal falls within this range, the DA converter 107 can perform the DA conversion normally, but when the signal before the conversion into the analog signal exceeds this range, the overflow occurs, and it is difficult to perform the DA conversion properly.

Further, for example, when a noise signal having an excessive amplitude is input to the signal processing device 100 via the microphone 20 due to vibration of a vehicle, change in atmospheric pressure, or the like, the overflow of the signal before it is input to the DA converter 107 may become a problem.

In this regard, a signal processing device 100 that analyzes a characteristic of the audio signal and controls the cancellation amount such that the overflow does not occur even when the audio signal and the noise cancellation signal are added as will be described below.

Figure 7:
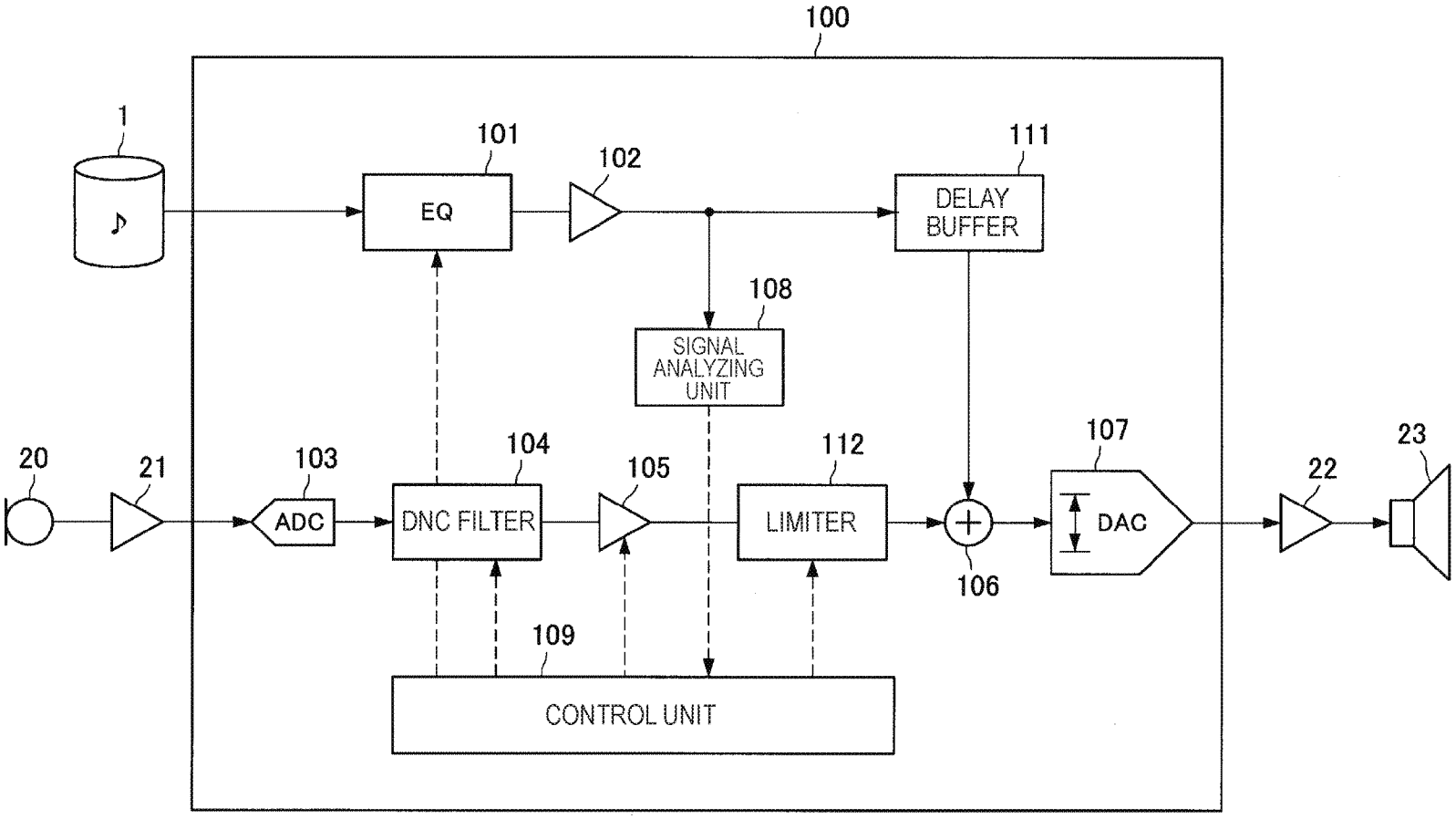
FIG. 7 is an explanatory diagram illustrating an exemplary functional configuration of the signal processing device 100 according to an embodiment of the present disclosure.

FIG. 7 is an explanatory diagram illustrating an exemplary functional configuration of a signal processing device 100 according to an embodiment of the present disclosure. FIG. 7 illustrates an example functional configuration of a signal processing device 100 which can prevent the overflow of the audio signal after the noise cancellation using the analysis result of the audio signal. An exemplary functional configuration of the signal processing device 100 according to the embodiment of the present disclosure will be described below with reference to FIG. 7.

As illustrated in FIG. 7, the signal processing device 100 according to the embodiment of the present disclosure includes an equalizer 101, a volume adjusting unit 102, an AD converter (ADC) 103, a DNC filter 104, a cancellation amount adjusting unit 105, an adding unit 106, a DA converter (DAC) 107, a signal analyzing unit 108, a control unit 109, a delay buffer 111, and a limiter 112.

The signal processing device 100 illustrated in FIG. 7 has a configuration in which the delay buffer 111 and the limiter 112 are added to the configuration of the signal processing device 100 illustrated in FIG. 1.

The delay buffer 111 performs a process of delaying the audio signal output from the volume adjusting unit 102 by a predetermined period of time in view of a processing time of signal processing in the limiter 112 which is added in the signal processing device 100 illustrated in FIG. 7. By delaying the audio signal output from the volume adjusting unit 102 through the delay buffer 111 by a predetermined period of time, the adding unit 106 can add the audio signal and the noise cancellation signal at the same time.

The limiter 112 performs signal processing for imposing a limitation on the noise cancellation signal output from the cancellation amount adjusting unit 105 according to a level of the audio signal output from the volume adjusting unit 102. As described above, when the signal before the conversion into the analog signal does not fall within the convertible range of the DA converter 107, the overflow occurs, and it is difficult to perform the DA conversion properly. In this regard, the limiter 112 imposes a limitation on the noise cancellation signal output from the cancellation amount adjusting unit 105 so that it falls within the convertible range of the DA converter 107.

In order to impose a limitation on the noise cancellation signal so that it falls within the convertible range of the DA converter 107, the limiter 112 detects the level of the audio signal output from the volume adjusting unit 102, which is likely to change sequentially. Therefore, the signal analyzing unit 108 analyzes the magnitude of the level of the audio signal as the signal processing for the audio signal. Then, the control unit 109 obtains information about the magnitude of the level of the audio signal level from the signal analyzing unit 108 and transfers the information about the magnitude of the level of the audio signal level to the limiter 112.

In other words, in the signal processing device 100 illustrated in FIG. 7, the control parameter corresponds to the information about the magnitude of the level of the audio signal. Further, the signal analyzing unit 108 may obtain the level of the audio signal using a root mean square (RMS) (an effective value).

When the information about the magnitude of the level of the audio signal level is obtained from the control unit 109, the limiter 112 imposes a limitation on the noise cancellation signal output from the cancellation amount adjusting unit 105 so that it falls within the convertible range of the DA converter 107.

Figure 8:
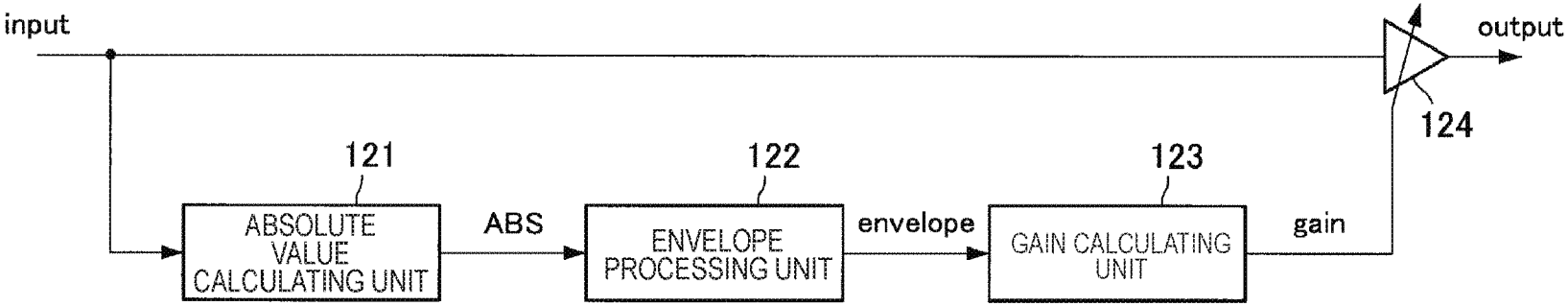
FIG. 8 is an explanatory diagram illustrating an exemplary functional configuration of a limiter 112.

Here, an exemplary functional configuration of the limiter 112 will be described. FIG. 8 is an explanatory diagram illustrating an exemplary functional configuration of the limiter 112. As illustrated in FIG. 8, the limiter 112 is configured to include an absolute value calculating unit 121, an envelope processing unit 122, a gain calculating unit 123, and a gain processing unit 124.

The absolute value calculating unit 121 calculates an absolute value ABS of a signal which is input. In the present embodiment, the absolute value calculating unit 121 calculates the absolute value ABS of the noise cancellation signal output from the cancellation amount adjusting unit 105. The absolute value calculating unit 121 calculates the absolute value ABS of the noise cancellation signal output from the cancellation amount adjusting unit 105, and transfers the calculated absolute value ABS to the envelope processing unit 122.

The envelope processing unit 122 performs a process of changing an absolute value envelope with respect to the absolute value ABS of the noise cancellation signal output from the absolute value calculating unit 121. In the present embodiment, the process of changing the absolute value envelope is also referred to as an "envelope process." The envelope processing unit 122 outputs the envelope after the envelope processing to the gain calculating unit 123.

The envelope process performed by the envelope processing unit 122 will be described. The envelope processing unit 122 compares an envelope value z1env one cycle before with the absolute value ABS of the noise cancellation signal output from the absolute value calculating unit 121, and performs the following process:

(1) attack process when ABS>z1env envelope=$z1env+ta\times(ABS-z1env)$; and (2) release process when ABS<=z1env envelope=$tr\times z1env$ Here, "ta" and "tr" are constants which are calculated based on an attack time and a release time.

The gain calculating unit 123 calculates a gain to be applied to a signal which is input based on the envelope output from the envelope processing unit 122. In the present embodiment, the gain calculating unit 123 calculates a gain to be applied to the noise cancellation signal output from the cancellation amount adjusting unit 105 based on the envelope envelope output from the envelope processing unit 122.

A process of calculating the gain by the gain calculating unit 123 will be described.

(1) When envelope>limit, gain=limit/envelope (2) When envelope<=limit gain=1.0

The limit is an output limit restriction value which is set in advance.

The gain calculating unit 123 can calculate the gain according to the level of the noise cancellation signal output from the cancellation amount adjusting unit 105, that is, the value of the envelope output from the envelope processing unit 122. The output limit restriction value is set in the gain calculated by the gain calculating unit 123 in advance. A transient response characteristic is controlled based on the constants ta and tr for determining sensitivity of detection of the value of the envelope.

The output limit restriction value may be changed by the analysis of the magnitude of the level of the audio signal by the signal analyzing unit 108. For example, the output limit restriction value limit can be changed by the control unit 109, that is, when the level of the audio signal is low, the output limit restriction value limit is increased, and when the level of the audio signal is high, the output limit restriction value limit is decreased. As described above, the output limit restriction value limit is changed according to the magnitude of the level of the audio signal, and thus the signal processing device 100 can show maximum noise cancellation performance according to the magnitude of the level of the audio signal.

The gain processing unit 124 applies the gain calculated by the gain calculating unit 123 to the signal which is input. In the present embodiment, the gain processing unit 124 applies the gain calculated by the gain calculating unit 123 to the noise cancellation signal output from the cancellation amount adjusting unit 105.

Figure 9:
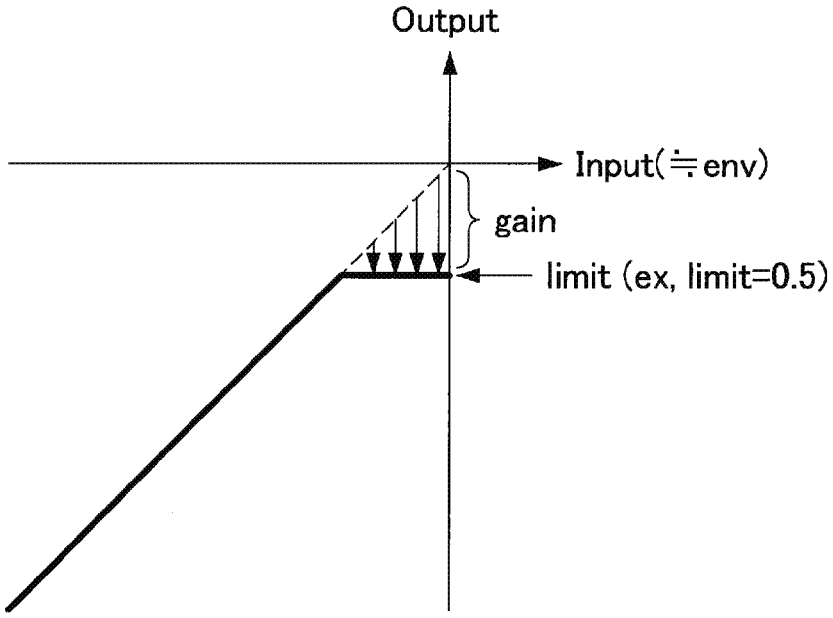
FIG. 9 is an explanatory diagram illustrating an example of a relation between a signal input to the limiter 112 and a signal output from the limiter 112 using a graph.

FIG. 9 is an explanatory diagram illustrating an example of a relation between a signal input to the limiter 112 and a signal output from the limiter 112 using a graph. In FIG. 9, the input is assumed to be substantially the same as the envelope output from the envelope processing unit 122. As illustrated in FIG. 9, when the input is the output limit restriction value limit or less, the gain calculating unit 123 calculates a gain for outputting the input without change. On the other hand, if the input exceeds the output limit restriction value limit, the gain calculating unit 123 calculates a gain for using the output limit restriction value limit as the output.

Figure 10:
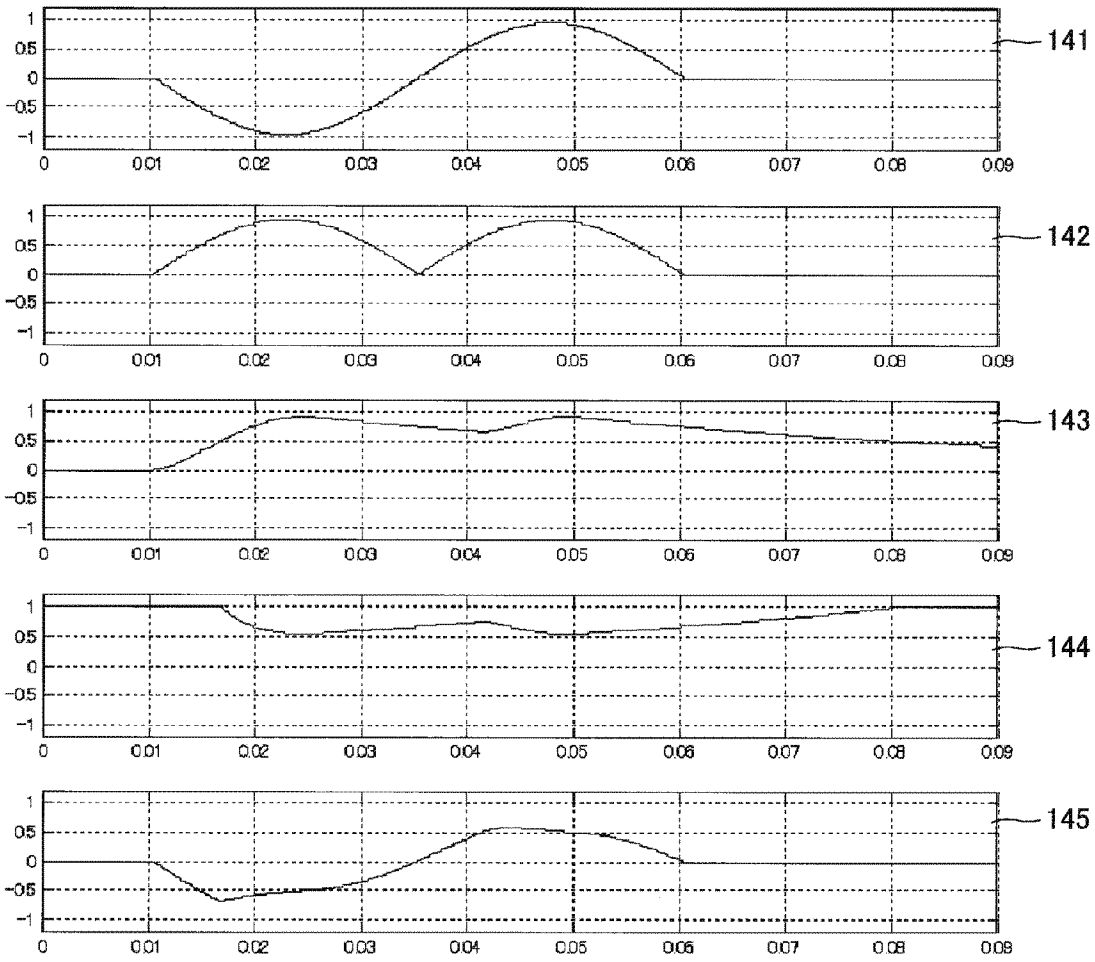
FIG. 10 is an explanatory diagram illustrating temporal transition of signals in the limiter 112 using a graph.

FIG. 10 is an explanatory diagram illustrating temporal transition of signals inside the limiter 112 using a graph. Reference numeral 141 indicates a graph of temporal transition of the signal input to the limiter 112, that is, the noise cancellation signal. Reference numeral 142 is a graph of temporal transition of a signal after the signal input to the limiter 112 passes through the absolute value calculating unit 121, and the absolute value is obtained. Reference numeral 143 is a graph of temporal transition of a signal obtained by performing the envelope process of the envelope processing unit 122 on the signal that has passed through the absolute value calculating unit 121. Reference numeral 144 is a graph of temporal transition of a value of a gain obtained by performing the gain calculation process of the gain calculating unit 123 on the signal that has undergone the envelope process of the envelope processing unit 122. Reference numeral 145 is a graph of temporal transition of a signal obtained by applying the gain calculated by the gain calculating unit 123 to the signal input to the limiter 112 through the gain calculating unit 124.

For example, when the output limit restriction value is set to 0.5 in the signal 143 after the envelope process, if the magnitude of the signal after the envelope process exceeds 0.5, the gain that causes the magnitude of the signal to be smaller than 1 is calculated by the gain calculating unit 123 as indicated by reference numeral 144. As a result, a waveform of the noise cancellation signal collapses due to the gain processing unit 124 in an interval in which the magnitude of the signal after the envelope process exceeds 0.5 as indicated by reference numeral 145.

As described above, the limiter 112 can impose a limitation of decreasing the magnitude of the noise cancellation signal when the noise cancellation signal in which the envelope envelope exceeds a predetermined output limit restriction value limit is generated.

The exemplary functional configuration of the limiter 112 has been described above with reference to FIG. 8. Next, effects of the limiter 112 will be described.

Figure 11:
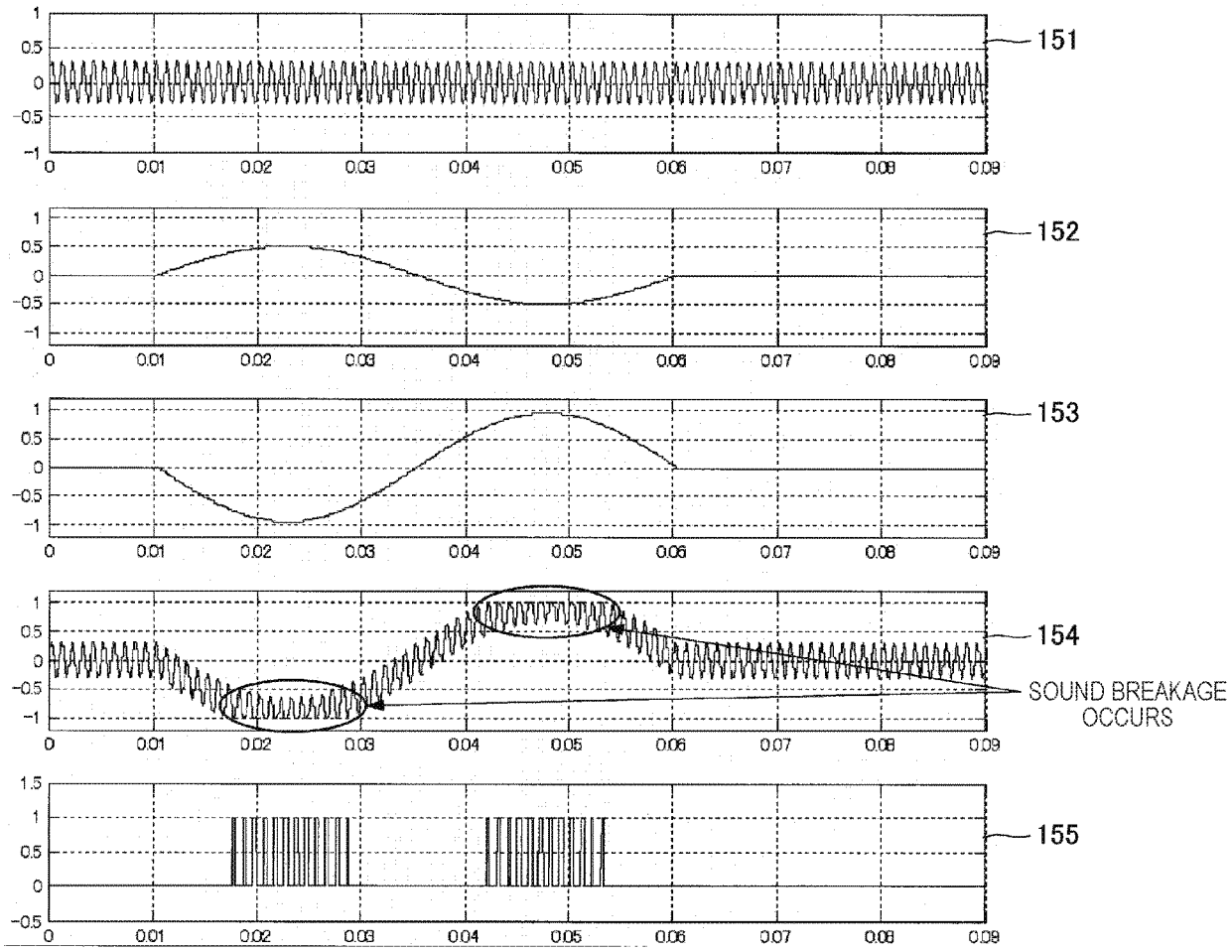
FIG. 11 is an explanatory diagram illustrating temporal transition of a signal when no limitation is imposed by the limiter 112 using a graph.

FIG. 11 is an explanatory diagram illustrating temporal transition of a signal when no limitation is imposed by the limiter 112 using a graph. Reference numeral 151 is a graph of temporal transition of an audio signal. Reference numeral 152 is a graph of temporal transition of a noise signal.

Reference numeral 153 is a graph of temporal transition of a noise cancellation signal generated based on the noise signal. Reference numeral 154 is a graph of temporal transition of a signal obtained by adding the audio signal indicated by reference numeral 151 to the noise cancellation signal indicated by reference numeral 153. Reference numeral 155 is a graph of temporal transition of the occurrence of overflow.

As illustrated in FIG. 11, when no limitation is imposed by the limiter 112, the overflow may occur at the time of DA conversion, depending on the magnitude of the audio signal or the noise cancellation signal as in the graphs indicated by reference numerals 154 and 155. This overflow causes sound collapse or sound breakage, and the listener is likely to have an uncomfortable feeling due to the sound collapse or sound breakage.

Figure 12:
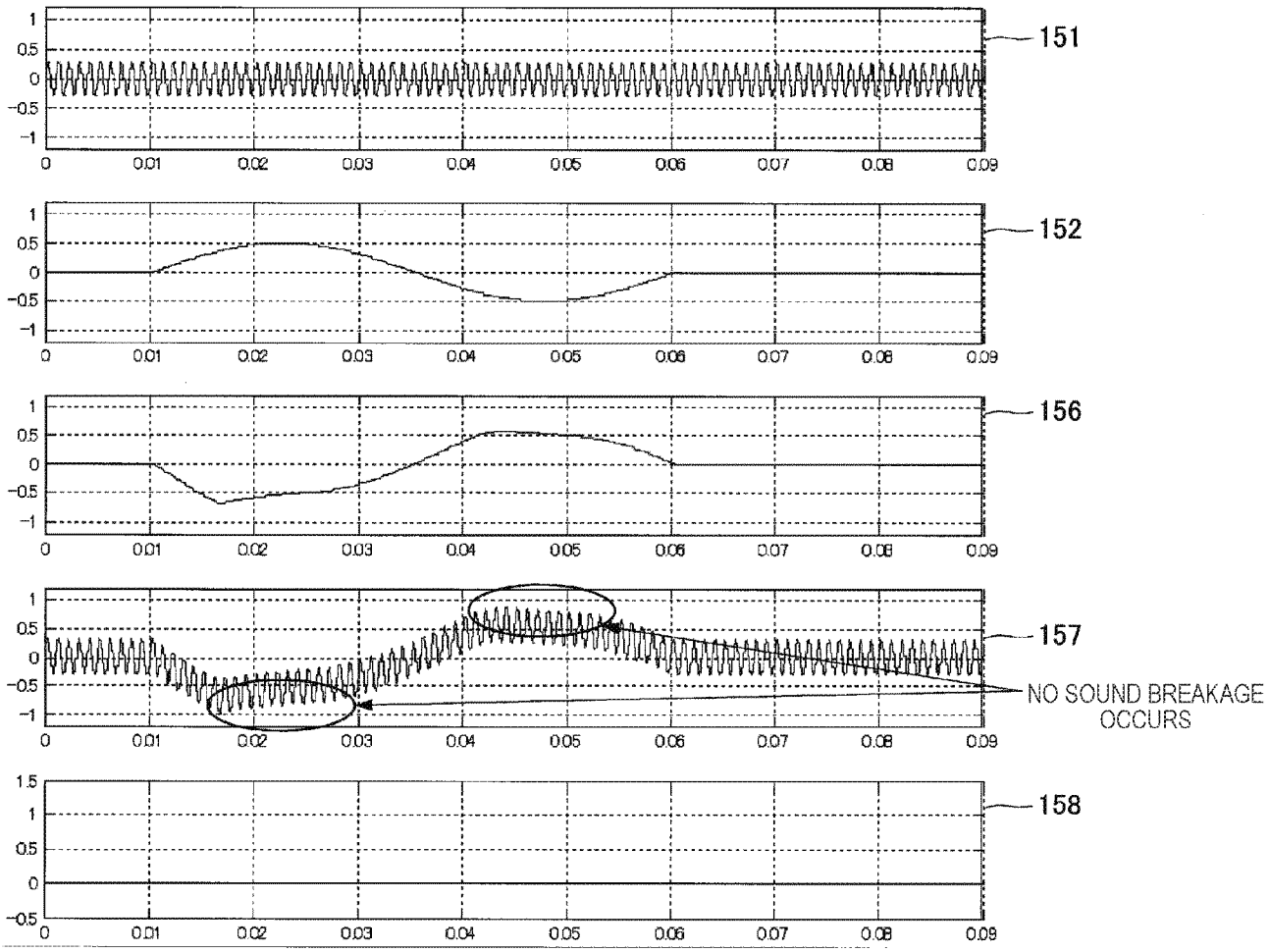
FIG. 12 is an explanatory diagram illustrating temporal transition of signals when a limitation is imposed by a limiter using a graph.

FIG. 12 is an explanatory diagram illustrating temporal transition of a signal when a limitation is imposed by the limiter 112 using a graph. Reference numeral 151 is a graph of temporal transition of an audio signal. Reference numeral 152 is a graph of temporal transition of a noise signal. Reference numeral 156 is a graph of temporal transition of a signal obtained by imposing a limitation on a noise cancellation signal generated based on the noise signal through the limiter 112. Reference numeral 157 is a graph of temporal transition of a signal obtained by adding the audio signal indicated by reference numeral 151 to the noise cancellation signal indicated by reference numeral 156. Reference numeral 158 is a graph of temporal transition of the occurrence of overflow.

As illustrated in FIG. 12, the overflow at the time of DA conversion which occurs according to the magnitude of the audio signal or the noise cancellation signal when the limiter 112 does not impose a limitation does not occur when the limiter 112 imposes a limitation. Therefore, neither sound collapse nor sound breakage which may be caused by the overflow occurs, and it is possible to enable the listener to listen to the sound without having an uncomfortable feeling.

As a result, when the level of the audio signal is high and the overflow is predicted when the audio signal is added to the noise cancellation signal, the signal processing device 100 enables the limiter 112 in a path in which the noise cancellation process is performed through, for example, the control unit 109, and thus it is possible to prevent the sound based on the audio signal from undergoing the sound breakage when excessive noise is input. Further, when the level of the audio signal is low, the signal processing device 100 disables the limiter 112 through, for example, the control unit 109, and thus it is possible to sufficiently allocate the dynamic range before the audio signal is input to the DA converter 107 to the noise cancellation signal and implement the satisfactory noise cancellation function.

Further, the control of the limiter 112 may be control of parameters such as the output limit restriction value limit, attack, or release in addition to ON/OFF. By dynamically controlling the path of the noise cancellation process while analyzing the level of the audio signal, the signal processing device 100 can prevent sound breakage of the sound based on the audio signal and reproduce the sound based on the audio signal without improperly suppressing the noise cancellation signal through the limiter 112.

Further, in addition to provision of the limiter 112 in the path of the noise canceling process as described above, control of the limiter described above may be performed on a path of signal processing for the audio signal 1.

Figure 13:
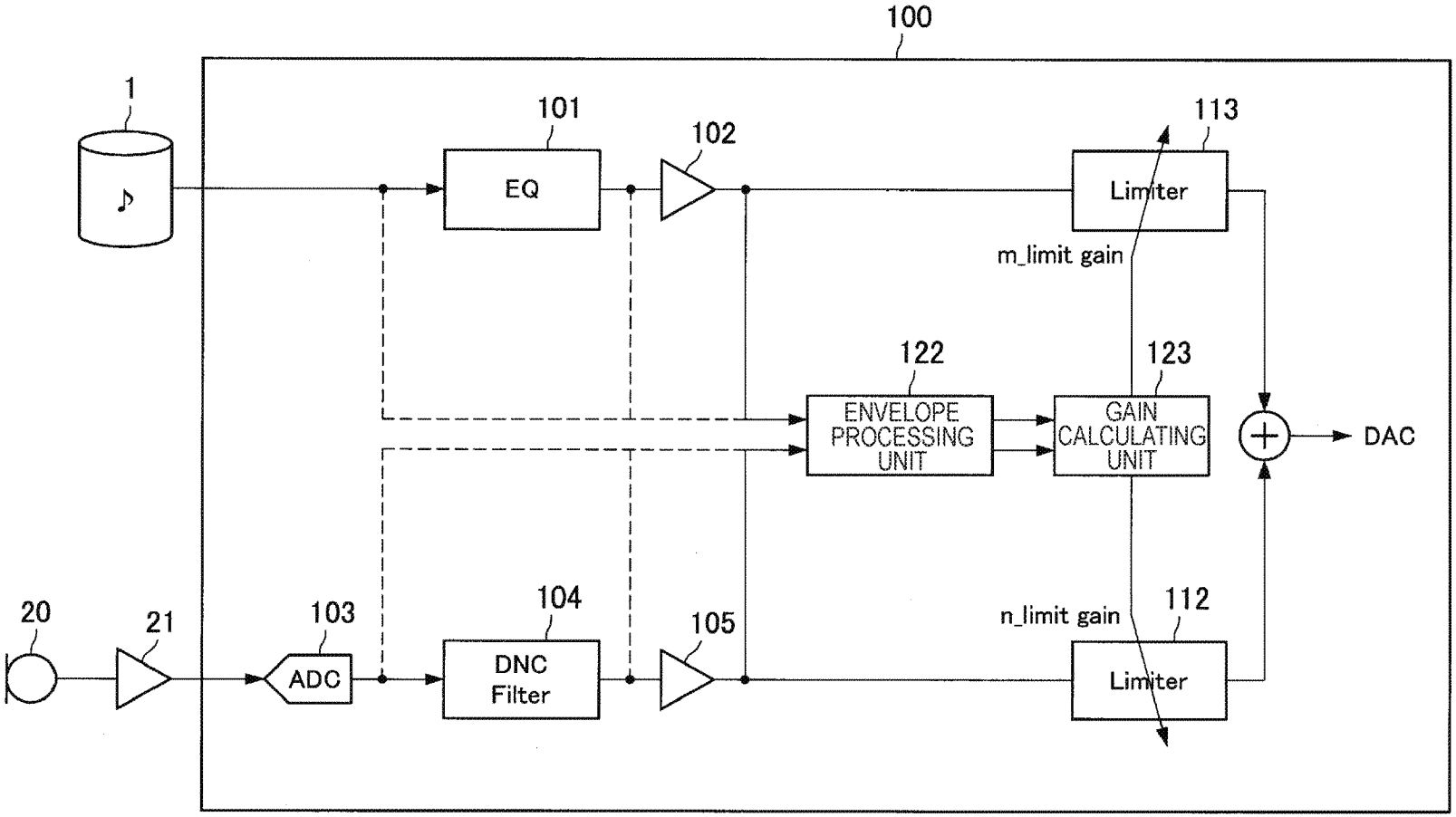
FIG. 13 is an explanatory diagram illustrating an exemplary functional configuration of the signal processing device 100 according to an embodiment of the present disclosure.

FIG. 13 is an explanatory diagram illustrating an exemplary functional configuration of a signal processing device 100 according to an embodiment of the present disclosure. FIG. 13 illustrates an exemplary functional configuration of a signal processing device 100 that includes a limiter 113 that performs limiter control on the audio signal in addition to a limiter 112 that performs limiter control on the noise cancellation signal.

The signal processing device 100 illustrated in FIG. 13 performs the envelope process on the audio signal output from the volume adjusting unit 102 through the envelope processing unit 122 in addition to the noise cancellation signal output from the cancellation amount adjusting unit 105. In FIG. 13, the absolute value calculating unit 121 at the preceding stage of the envelope processing unit 122 is omitted. Further, the envelope processing unit 122 reflects the results of the envelope processing on the noise cancellation signal and the audio signal in output limit restriction values m_limit_gain and n_limit_gain of the noise cancellation signal and the audio signal.

Signals of portions indicated by dotted lines in FIG. 13 can be used as an input signal to the absolute value calculation process or the envelope processing unit 122, but the following description will proceed using an example using paths of solid lines in FIG. 13.

When a sum of the envelope values of the audio signal and the noise cancellation signal exceeds 1.0, the signal processing device 100 illustrated in FIG. 13 may change the gain calculation process of the gain calculating unit 123 depending on whether priority is given to the output of the sound based on the audio signal or the noise cancellation process. Hereinafter, an operation mode in which priority is given to the output of the sound based on the audio signal is referred to as a "music priority mode," and an operation mode in which priority is given to the noise cancellation process is referred to as a "noise cancellation priority mode."

(1) Music Priority Mode

The envelope processing unit 122 controls the output limit restriction value n_limit_gain which is output to the limiter 112 that performs the limiter control on the noise cancellation signal such that a sum of the envelope values of the audio signal and the noise cancellation signal is 1.0 or less in order to maintain the output limit restriction value m_limit_gain which is output to the limiter 113 that performs the limiter control on the audio signal at 1.0 whenever possible.

(2) Noise Cancellation Priority Mode

The envelope processing unit 122 controls the output limit restriction value m_limit_gain which is output to the limiter 113 that performs the limiter control on the audio signal such that a sum of the envelope values of the audio signal and the noise cancellation signal is 1.0 or less in order to maintain the output limit restriction value n_limit_gain which is output to the limiter 112 that performs the limiter control on the noise cancellation signal at 1.0 whenever possible.

Which of the music priority mode and the noise cancellation process priority is given to can be appropriately selected according to a setting by the listener. Further, it will be appreciated that a method in which the music priority mode and the noise cancellation process are combined can also be used in addition to selection of one of the music priority mode and the noise cancellation process.

The application example of the technology of the signal processing device 100 to the embodiment of the present disclosure has been described above. As described above, it is possible to analyze the audio signal input to the signal processing device 100 in real time and adjust the magnitude of the noise cancellation signal and/or the audio signal so that the overflow does not occur at the time of DA conversion using the analysis result of the audio signal 1.

2. Conclusion

As described above, according to the embodiment of the present disclosure, the signal processing device 100 that analyzes an input audio signal and noise collected through the microphone, and generates the control parameter for generating the noise cancellation signal for cancelling the noise based on the noise collected through the microphone is provided.

The signal processing device 100 according to the embodiment of the present disclosure analyzes the input audio signal and the noise collected through the microphone in real time and analyzes the noise masking effect of the audio signal. Further, the signal processing device 100 according to the embodiment of the present disclosure generates the control parameter for generating the noise cancellation signal based on the analysis result of the masking effect.

Since the signal processing device 100 according to the embodiment of the present disclosure generates the control parameter for generating the noise cancellation signal based on the analysis result of the masking effect, the noise cancellation signal is not generated for the frequency region masked by the audio signal, and corresponding resources are allocated to other frequency regions, and thus it is possible to effectively use resources for generating the noise cancellation signal.

Further, the signal processing device 100 according to the embodiment of the present disclosure analyzes the input audio signal in real time, analyzes the noise cancellation signal in real time as necessary, and adjusts the magnitude of the noise cancellation signal and/or the audio signal within the range in which the overflow does not occur at the time of DA conversion. Since the signal processing device 100 according to the embodiment of the present disclosure adjusts the magnitude of the noise cancellation signal and/or the audio signal within the range in which the overflow does not occur at the time of DA conversion, it is possible to enable the listener to listen to a satisfactory sound in which neither sound collapse nor sound breakage occurs.

Further, the signal processing devices 100 according to the above embodiments can be mounted on, for example, portable music players, smartphones, tablet type portable terminals, portable game machines, or the like.

Steps in processes executed by devices in this specification are not necessarily executed chronologically in the order described in a sequence chart or a flow chart. For example, steps in processes executed by devices may be executed in a different order from the order described in a flow chart or may be executed in parallel.

Further, a computer program can be created which causes hardware such as a CPU, ROM, or RAM, incorporated in each of the devices, to function in a manner similar to that of structures in the above-described devices. Furthermore, it is possible to provide a recording medium having the computer program recorded thereon. Moreover, by configuring respective functional blocks shown in a functional block diagram as hardware, the hardware can achieve a series of processes.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art based on the description of this specification.

Additionally, the present technology may also be configured as below.

(1)

A signal processing device including:

a signal analyzing unit configured to analyze a second audio signal based on a first audio signal which is input and a sound collected through a microphone;

a cancellation processing unit configured to generate a cancellation signal for canceling the second audio signal; and a parameter generating unit configured to generate a control parameter used in the cancellation processing unit based on a result of analysis performed by the signal analyzing unit.

(2)

The signal processing device according to (1), wherein the signal analyzing unit performs masking analysis of the first audio signal and the second audio signal.

(3)

The signal processing device according to (2), wherein the parameter generating unit generates a control parameter that causes the cancellation processing unit to cancel the second audio signal in a band other than a band masked by the first audio signal based on a result of the masking analysis performed by the signal analyzing unit.

(4)

The signal processing device according to (3), wherein the cancellation processing unit includes a plurality of filters, and the parameter generating unit selects one filter from among the plurality of filters based on the result of the analysis performed by the signal analyzing unit.

(5)

The signal processing device according to any of (2) to (4), further including a sound insulation filter unit configured to reproduce an effect in which the sound collected through the microphone is insulated by a housing of a headphone before reaching an ear of a listener at a preceding stage of the signal analyzing unit.

(6)

The signal processing device according to any of (1) to (5), wherein the parameter generating unit further generates a control parameter used in an equalizer configured to change a frequency characteristic of the first audio signal.

(7)

The signal processing device according to (1), wherein the signal analyzing unit performs level analysis of the first audio signal.

(8)

The signal processing device according to (7), further including a level adjustment unit configured to adjust a level of the cancellation signal output from the cancellation processing unit based on a result of the level analysis of the first audio signal performed by the signal analyzing unit.

(9)

The signal processing device according to (7), wherein the signal analyzing unit performs level analysis of the second audio signal.

(10)

The signal processing device according to (9), further including a level adjustment unit configured to adjust a level of the cancellation signal output from the cancellation processing unit based on results of the level analysis of the first audio signal and the level analysis of the second audio signal performed by the signal analyzing unit.

(11)

A signal processing method including:

analyzing a second audio signal based on a first audio signal which is input and a sound collected through a microphone;

generating a cancellation signal for canceling the second audio signal; and generating a control parameter used in the generation of the cancellation signal based on a result of the analysis.

(12)

A computer program causing a computer to execute:

analyzing a second audio signal based on a first audio signal which is input and a sound collected through a microphone;

generating a cancellation signal for canceling the second audio signal; and generating a control parameter used in the generation of the cancellation signal based on a result of the analysis.

REFERENCE SIGNS LIST

20 microphone
21 microphone amplifier
22 headphone amplifier
23 driver
100 signal processing device
101 equalizer
102 volume adjusting unit
103 AD converter
104 DNC filter
105 cancellation amount adjusting unit
106 adding unit
107 DA converter
108 signal analyzing unit
109 control unit
110 passive sound insulation filter
111 delay buffer
112, 113 limiter
121 absolute value calculating unit
122 envelope processing unit
123 gain calculating unit
124 gain processing unit

The invention claimed is:

1. A signal processing device, comprising:

circuitry configured to:

analyze a first frequency of a first audio signal and a second frequency of a second audio signal, wherein the first audio signal is input to the signal processing device, and wherein the second audio signal corresponds to a sound collected through a microphone;

calculate a first masking effect of the first audio signal over the second audio signal and a second masking effect of the second audio signal over the first audio signal, wherein the first masking effect and the second masking effect are calculated based on the analysis of the first frequency and the second frequency;

generate a control parameter based on the calculated first masking effect and the calculated second masking effect; and generate a cancellation signal, to cancel the second audio signal, based on the control parameter.

2. The signal processing device according to claim 1, wherein the circuitry is further configured to generate the cancellation signal in a first frequency band based on the calculated first masking effect of the first audio signal and the calculated second masking effect of the second audio signal, wherein the second audio signal is masked by the first audio signal in a second frequency band, and wherein the second frequency band is different from the first frequency band.

3. The signal processing device according to claim 1, further comprising a plurality of filters, wherein the circuitry is further configured to select a filter from the plurality of filters based on the calculated first masking effect and the calculated second masking effect.

4. The signal processing device according to claim 1, further comprising a sound insulation filter, wherein the sound insulation filter is configured to attenuate the sound collected through the microphone before the calculation of the first masking effect of the first audio signal and the second masking effect of the second audio signal.

5. The signal processing device according to claim 1, wherein the circuitry is further configured to change a characteristic of the first frequency of the first audio signal.

6. The signal processing device according to claim 1, wherein the circuitry is further configured to analyze a first level of the first audio signal.

7. The signal processing device according to claim 6, wherein the circuitry is further configured to adjust a second level of the cancellation signal based on the analyzed first level of the first audio signal.

8. The signal processing device according to claim 6, wherein the circuitry is further configured to analyze a third level of the second audio signal.

9. The signal processing device according to claim 8, wherein the circuitry is further configured to adjust a second level of the cancellation signal based on the analyzed first level of the first audio signal and the analyzed third level of the second audio signal.

10. A signal processing method, comprising:

in a signal processing device:

analyzing a first frequency of a first audio signal and a second frequency of a second audio signal, wherein the first audio signal is input to the signal processing device, and wherein the second audio signal corresponds to a sound collected through a microphone;

calculating a first masking effect of the first audio signal over the second audio signal and a second masking effect of the second audio signal over the first audio signal, wherein the first masking effect and the second masking effect are calculated based on the analysis of the first frequency and the second frequency;

generating a control parameter based on the calculated first masking effect and the calculated second masking effect; and generating a cancellation signal, to cancel the second audio signal, based on the control parameter.

11. A non-transitory computer-readable medium having stored thereon computer-executable instructions which, when executed by a signal processing device, cause the signal processing device to execute operations, the operations comprising:

analyzing a first frequency of a first audio signal and a second frequency of a second audio signal, wherein the first audio signal is input to the signal processing device, and wherein the second audio signal corresponds to a sound collected through a microphone;

calculating a first masking effect of the first audio signal over the second audio signal and a second masking effect of the second audio signal over the first audio signal, wherein the first masking effect and the second masking effect are calculated based on the analysis of the first frequency and the second frequency;

generating a control parameter based on the calculated first masking effect and the calculated second masking effect; and generating a cancellation signal, to cancel the second audio signal, based on the control parameter.

* * * * *